US006196168B1

(12) United States Patent
Eckerskorn et al.

(10) Patent No.: US 6,196,168 B1
(45) Date of Patent: Mar. 6, 2001

(54) DEVICE AND METHOD FOR COOLING AND PREHEATING

(75) Inventors: Winfried Eckerskorn, Ottobrunn; Axel Temmesfeld, Raubling; Heinz Lemberger, Unterfohring; Christian Absmeier, Hörgertshausen; Gerhart Huemer, München; Victor Brost, Aichtal; Klaus Kalbacher, Rangendingen; Karl Schütterle, Walddorfhäslach, all of (DE)

(73) Assignees: Modine Manufacturing Company, Racine, WI (US); Bayerische Motoren Werke, Munich (DE)

( * ) Notice: Subject to any disclaimer, the term of this patent is extended or adjusted under 35 U.S.C. 154(b) by 0 days.

(21) Appl. No.: 09/068,815

(22) PCT Filed: Aug. 23, 1997

(86) PCT No.: PCT/EP97/04604

§ 371 Date: Aug. 13, 1998

§ 102(e) Date: Aug. 13, 1998

(87) PCT Pub. No.: WO98/12425

PCT Pub. Date: Mar. 26, 1998

(30) Foreign Application Priority Data

Sep. 17, 1996 (DE) ..... 196 37 817

(51) Int. Cl.[7] ..... F01P 3/20; F01P 11/02; F01P 7/16

(52) U.S. Cl. ..... 123/41.33; 123/41.49; 165/287

(58) Field of Search ..... 123/41.08, 41.09, 123/41.1, 41.31, 41.33, 142.5 E, 142.5 R, 196 AB, 41.49; 236/34.5; 165/DIG. 109, DIG. 110, 287; 477/98

(56) References Cited

U.S. PATENT DOCUMENTS 2,188,172 * 1/1940 Brehob ..... 123/41.33
2,435,041 * 1/1948 Hild ..... 123/41.1
3,134,371 * 5/1964 Crooks ..... 123/41.31

(List continued on next page.)

FOREIGN PATENT DOCUMENTS

3517567 A1 * 12/1995 (DE) ..... 123/41.1

*Primary Examiner*—Henry C. Yuen
*Assistant Examiner*—Arnold Castro
(74) *Attorney, Agent, or Firm*—Wood, Phillips, VanSanten, Clark & Mortimer

(57) ABSTRACT

The invention concerns a device and method for cooling and preheating, especially of transmission fluid, of an internal combustion engine, with an equalization tank, with at least one radiator, which can be connected by means of an engine thermostat when a predetermined temperature is reached in the cooling loop, and with a water/oil heat exchanger. It is prescribed according to the invention that the forward stream (1) of a single water/oil heat exchanger (5) be branched off in the heating phase by means of a valve unit (3) essentially from the main cooling loop (12) of the internal combustion engine (17) and that its forward stream (1) in the cooling phase be taken by means of the same valve unit (3) essentially in the coolant side stream (13) from the low-temperature region (14) of the radiator (4) or a separate low-temperature cooler (14*a*) connected in the side stream after radiator (4, 4*a*). The method proposes that the forward stream (1) of the water/oil heat exchanger (5) be taken in the heating phase essentially from the main coolant stream (12) not flowing through the radiator (4), that switching to cooling operation occur at a temperature lying somewhat below the switch point of the engine main thermostat (9) and the forward stream (1) of the water/oil heat exchanger (5) in cooling operation be branched off essentially from the low-temperature region (14) of radiator (4), or from a low-temperature cooler (14*a*) additionally connected in the side stream after radiator (4, 4*a*).

13 Claims, 5 Drawing Sheets

U.S. PATENT DOCUMENTS 3,851,629 * 12/1974 Mayr et al. ..... 123/41.08
4,517,929 * 5/1985 Musick et al. ..... 123/41.1
4,883,225 * 11/1989 Kitchens ..... 236/34.5
4,911,110 * 3/1990 Isoda et al. ..... 123/41.14
5,529,026 * 6/1996 Kurr et al. ..... 123/41.1
5,558,055 * 9/1996 Schatz ..... 123/142.5 R
5,681,237 * 10/1997 Furukawa et al. ..... 477/98

* cited by examiner

DEVICE AND METHOD FOR COOLING AND PREHEATING

FIELD OF THE INVENTION

The invention concerns a device for cooling and preheating, especially of transmission fluid, of an internal combustion engine, with an equalization tank, with at least one radiator, which is connected by means of an engine thermostat when a predetermined temperature is reached in the cooling loop, and with a water/oil heat exchanger.

The invention also concerns a method for cooling and preheating.

BACKGROUND OF THE INVENTION

Oil cooling often occurs with oil/air coolers, using thermostats that respond to corresponding oil temperatures. These solutions are certainly quite effective at smaller cooler sizes, but with greater cooling output and correspondingly larger coolers a situation results, in which unduly low oil temperatures occur in many operating states, which adversely effect fuel consumption and lifetime of the internal combustion engine.

For this reason, a switch has since been made to optimize the oil temperature, i.e., to cool or heat the oil, as required. For this purpose, an additional oil/water heat exchanger is integrated in the cooling loop, which is connected or disconnected as required by means of a thermostat that responds to oil temperature. These thermostats often must be activated with an electrical control. Although this group of solutions was to offer optimized oil temperature, it also entails significant costs on the equipment side.

Oil/water heat exchangers integrated in the normal water loop are also used for transmission fluid cooling, which are often incorporated in a water tank of the radiator, but also can be provided separately. Only cooling is achieved in this group of solutions, but not preheating or heating.

It is stated in DE-OS 41 04 093 that both rapid heating of the passenger compartment and rapid achievement of the operating temperature of the engine and transmission fluid are the problem in the starting phase of internal combustion engines. A virtual cooling management system has been proposed here to better deal with these partially contradictory constraints, in which a microprocessor is supposed to influence the output of the different heat exchangers, based on signals from a series of temperature sensors in the different loops. This installation appears to be quite expensive and has a complicated and therefore vulnerable technical structure.

SUMMARY OF THE INVENTION

With the presented state of the art as point of departure, the task of the invention is to offer an efficiently functioning, as well as compact and cost-effective arrangement, for cooling and preheating of operating fluids, especially transmission fluid, for internal combustion engines with which both additional heating of the transmission fluid can be achieved in the starting phase of the engine without a significant adverse effect on heating of the passenger compartment, and more efficient oil cooling is possible without having to use additional air- or water-cooled oil coolers. The corresponding method for cooling and heating will also be stated.

This task is solved according to the invention with the features mentioned in the Patent Claims. The device according to the invention has only a single water/oil heat exchanger, which can be used both for and cooling of operating fluids, especially transmission fluid. A valve unit is prescribed for this purpose, which controls the forward stream of the mentioned heat exchanger. In the heating phase the heat exchanger receives a cooling water stream branched off from the main cooling loop, rapidly heated by operation of the internal combustion engine. However, this amount is so small that heating of the internal combustion engine itself and heating of the passenger compartment are scarcely affected at all. On the other hand, in the cooling phase, the forward stream is formed by means of the same valve unit in the coolant side stream essentially from the low-temperature region of the radiator. Alternatively or additionally to the low-temperature region of the radiator, at least one additional low temperature cooler can be provided, which is connected after the first-named radiator in the side stream. Because of the low-temperature region, which can be accomplished by means of additional flow through part of the radiator, the water/oil heat exchanger obtains a cooling water stream that is about 10° C. lower so that the oil to water temperature difference is increased and the cooling action improved. Even higher temperature differences can be achieved with the separate low-temperature cooler. There is also a possibility of a space-saving arrangement independent of the radiator.

A transitional region between the heating phase and cooling phase is situated at a temperature of about 80 to 90° C., in which the forward stream of the heat exchanger from the equalization tank is mixed with the [stream] from the low-temperature region of the radiator or alternatively from to the separate low-temperature cooler. Thus, both transmission fluid cooling in all operating situations, and heating, are possible merely by means of this one heat exchanger.

The fact that a forward stream from the low-temperature region of the radiator, or from the separate low-temperature cooler, is mixed with a minimal continuous stream from the equalization tank, i.e., a stream of higher temperature, additionally contributes to optimization of the oil temperature. Unduly low oil temperatures with their adverse consequences, as occur in particular during oil/air cooling over large trips, are avoided.

The low-temperature region of the radiator is accomplished, as known, by the fact that at least one partition is arranged in at least one water tank, which forces part of the water flowing through the radiator to flow with a U-shaped or meandering flow through the radiator. An additional connection is prescribed in the water tank within the low-temperature region, which is connected to the flow channels to the oil/water heat exchanger via a valve unit. The valve unit is accommodated in a housing that can be flow-connected to the equalization tank and on which two flow channels for the heat exchanger are molded, one of which is connected to the low-temperature region of the radiator or to the separate low-temperature cooler, and the other connected to the equalization tank. The housing that includes the valve unit preferably consists of an upper and lower mounting connector, which are joined by means of a quick-change connector. The upper mounting connector is then molded directly in the bottom region of the equalization tank and the lower mounting connector forms a single plastic injection-molded part with the flow channels of the heat exchanger. The return channel of the heat exchanger and the return connection of the equalization tank, as well as the return connector leading to the coolant pump, are also designed as a single injection-molded component. All these features mean that a compact design is achieved, since the mentioned components can be mounted in the immediate vicinity, for example, on the fan housing enclosing the radiator. Lines requiring space are therefore superfluous. All the media connections are designed as quick-change connections, which has a favorable effect on installation and disassembly.

A method for cooling and preheating is provided with which the efficiency of cooling and preheating can be improved. It has turned out to be particularly effective if the switch point of the valve unit to cooling operation is set slightly, say, 5° C., below the switch point of the engine main thermostat. Overall, it has been shown that the dynamic control process from mixing of cooler or warmer cooling water is best influenced over the entire control range.

The Patent Claims are referred to for additional features significant to the invention. Additional advantages of the invention follow from the subsequent description of practical examples. For this purpose, reference is made to the figures.

DETAILED DESCRIPTION OF THE PREFERRED EMBODIMENTS

Figure 1:
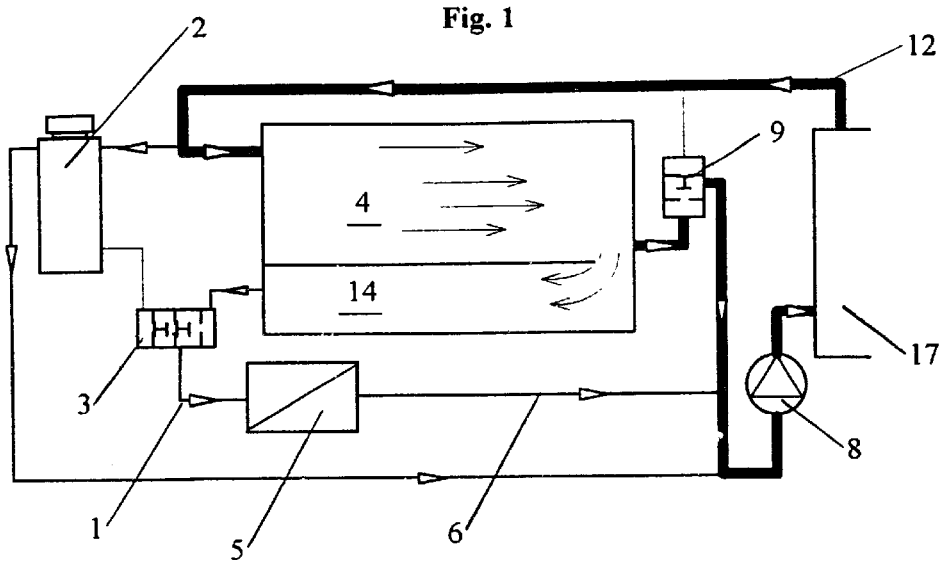
FIG. 1 shows a schematic circuit diagram of the cooling phase of a transmission fluid cooler.
Figure 2:
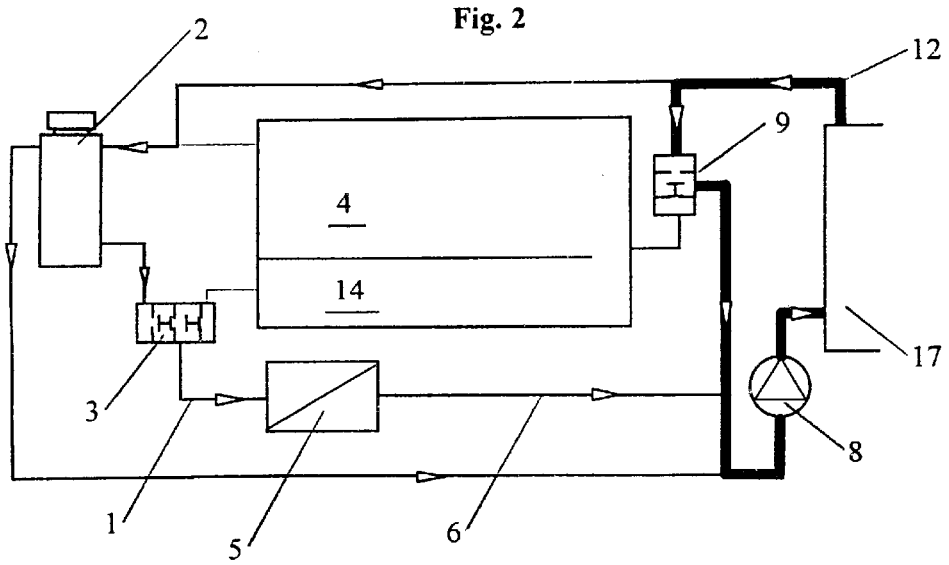
FIG. 2 shows a schematic circuit diagram of the heating or preheating phase.
Figure 3:
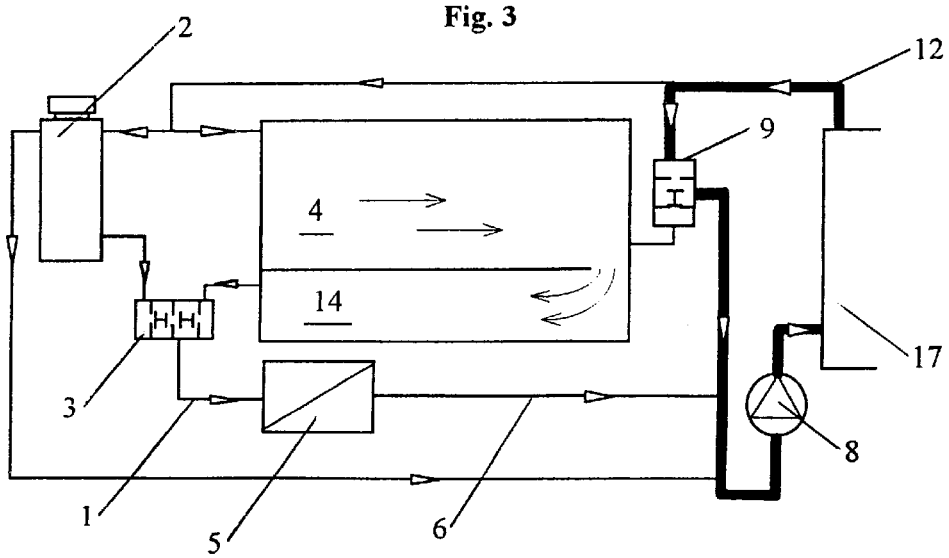
FIG. 3 shows a schematic circuit diagram in a transitional phase.
Figure 4:
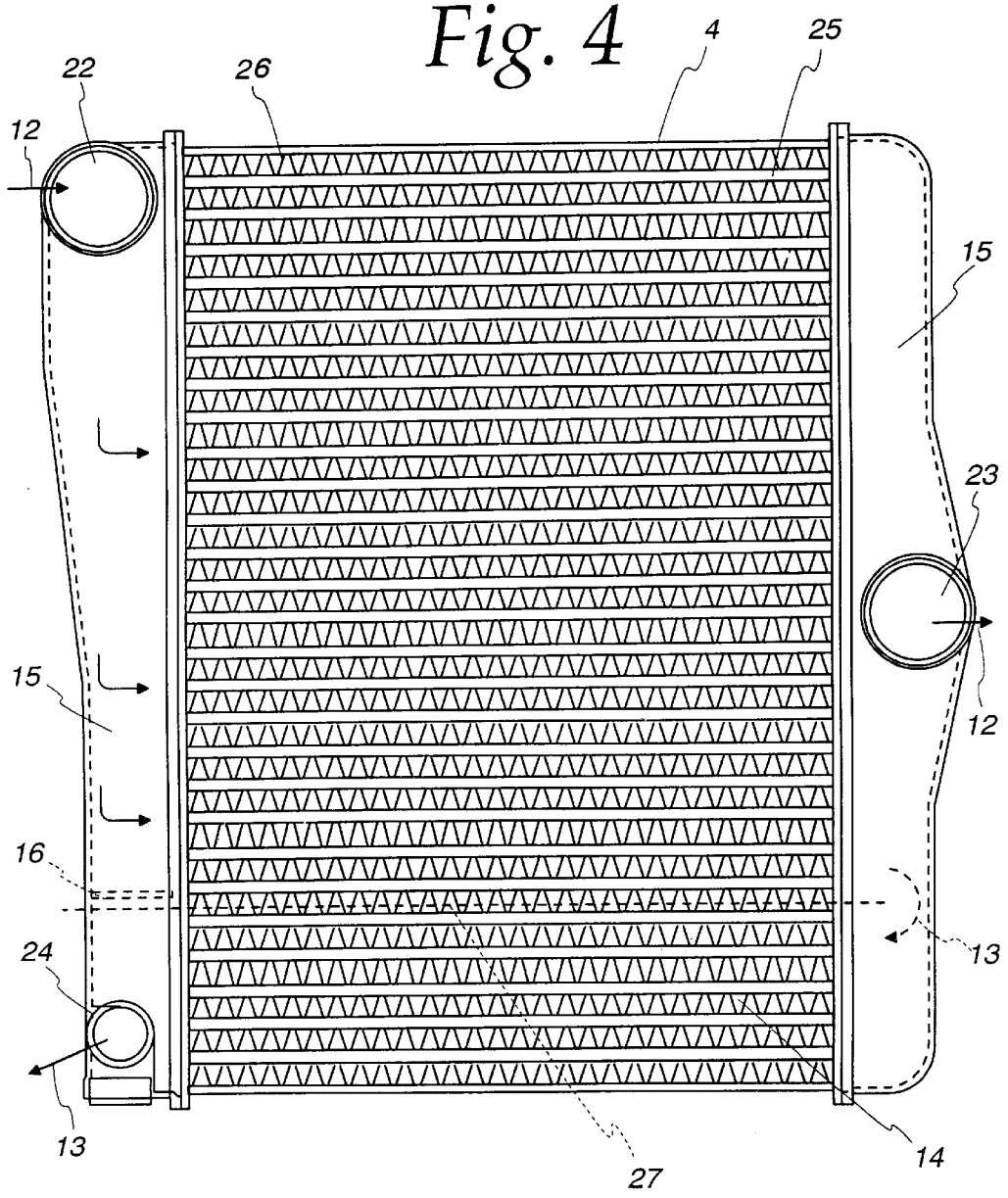
FIG. 4 shows a radiator (schematically) which has a partition in a water tank to form a low-temperature region.

The essential cooling loop, as encountered, for example, for cooling of an internal combustion engine (17) in a vehicle, is depicted in FIGS. 1 to 3. Components of the loop include radiator (4), equalization tank (2), engine thermostat (9) and coolant pump (8). When the internal combustion engine (17) is started, the main coolant stream (12) is returned directly to the internal combustion engine (17) by means of the engine thermostat (9) over a short path with disconnection of the radiator (4). This is depicted in the right part of FIGS. 2 and 3. In this case the internal combustion engine (17) heats the cooling water in a short time. The heat energy of the cooling water can be used, for example, to heat the passenger compartment, which will not be taken up here. A single oil/water heat exchanger (5), for example, a transmission fluid cooler, is incorporated additionally in the loop, the forward stream (1) of which can be controlled by means of valve unit (3). The valve unit (3) has a connection to the low-temperature region (14) of radiator (4) and an additional connection to the equalization tank (2). In the cooling phase, as shown in FIG. 1, for example, at a cooling water temperature of 110° C., the engine thermostat (9) has already blocked the short path so that the main cooling loop (12) runs through radiator (4) and back to coolant pump (8). Since valve unit (3) has also blocked the path to equalization tank (2) (except for a small continuous stream), the forward stream (1) of heat exchanger (5) essentially comes from the low-temperature region (14) of radiator (4). Because of this low-temperature region (14), the water temperature can be further cooled by 10° C., which is advantageous for transmission fluid cooling. FIG. 4 shows how this low-temperature region is formed, which will be taken up further below.

FIG. 2 shows the pure preheating phase of heat exchanger (5), in which the forward stream (1) is withdrawn from the equalization tank (2), which is flowed through by part of the main coolant stream (12). The valve unit (3) has opened the left input in the figure and closed the right input leading to the low-temperature region (14). Part of the cooling water quickly heated by the internal combustion engine (17) is thus made available for additional heating of the transmission fluid.

In a temperature range between 80 and 85° C., for example, just before the action temperature of engine thermostat (9), which could lie at 90° C., a transitional region has developed, as depicted in FIG. 3. In this temperature region the forward stream (1) of heat exchanger (5) comes from both equalization tank (2) and the low-temperature region (14), which is again useful for optimization of the oil temperature. Another operating situation (not shown) occurs with further increasing temperature, even if the engine thermostat (9) is already partially opened, during which the low-temperature region (14) is then only flowed through by a partial amount of the water flowing through radiator (4), as is apparent from FIG. 1.

The schematized radiator (4) is apparent from FIG. 4. A low-temperature region (14) is separated in this radiator (4), in which a partition (16) was inserted in the left water tank (15), which forces the water, or part of the water, to flow back through the radiator (4) in the opposite direction and in so doing to be cooled by an additional amount. The main coolant stream (12), or part of it, on the upper left enters an inlet connector (22) into radiator (4) and leaves it after flowing through on the right side at outlet connector (23) according to the arrow. The fraction flowing through the low-temperature region (14) forms the coolant side stream (13), which leaves the radiator (4) on the bottom left in order to enter the flow channel designated (10), which leads to heat exchanger (5). A connector (24) for connection to the flow channel (10) is shown in schematized form on water tank (15) with the low-temperature region (14).

Figure 5:
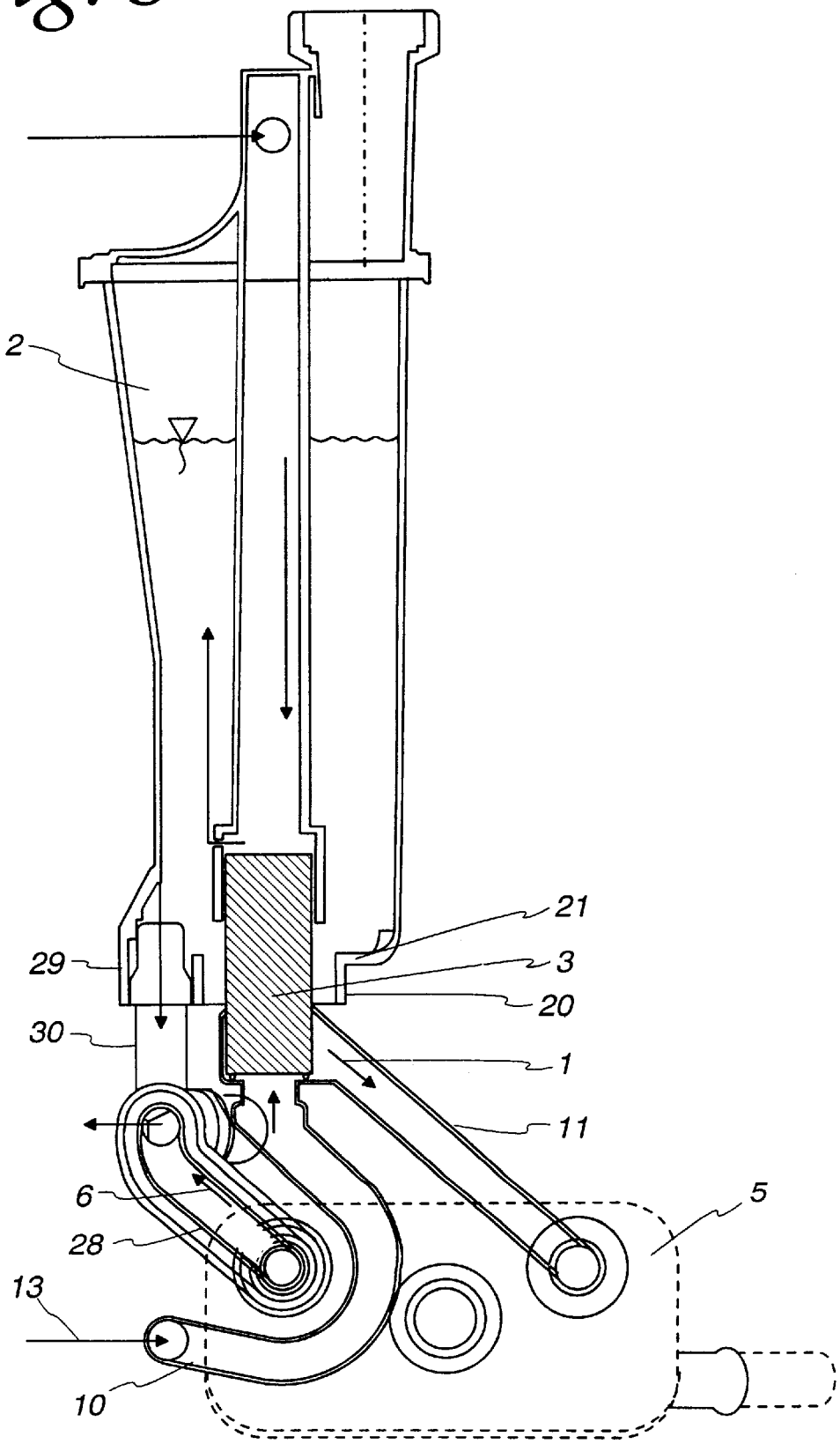
FIG. 5 shows an equalization tank with a mounting connector with inserted thermostat valve and channels to the indicated transmission fluid cooler and to the low-temperature region of the radiator.
Figure 6:
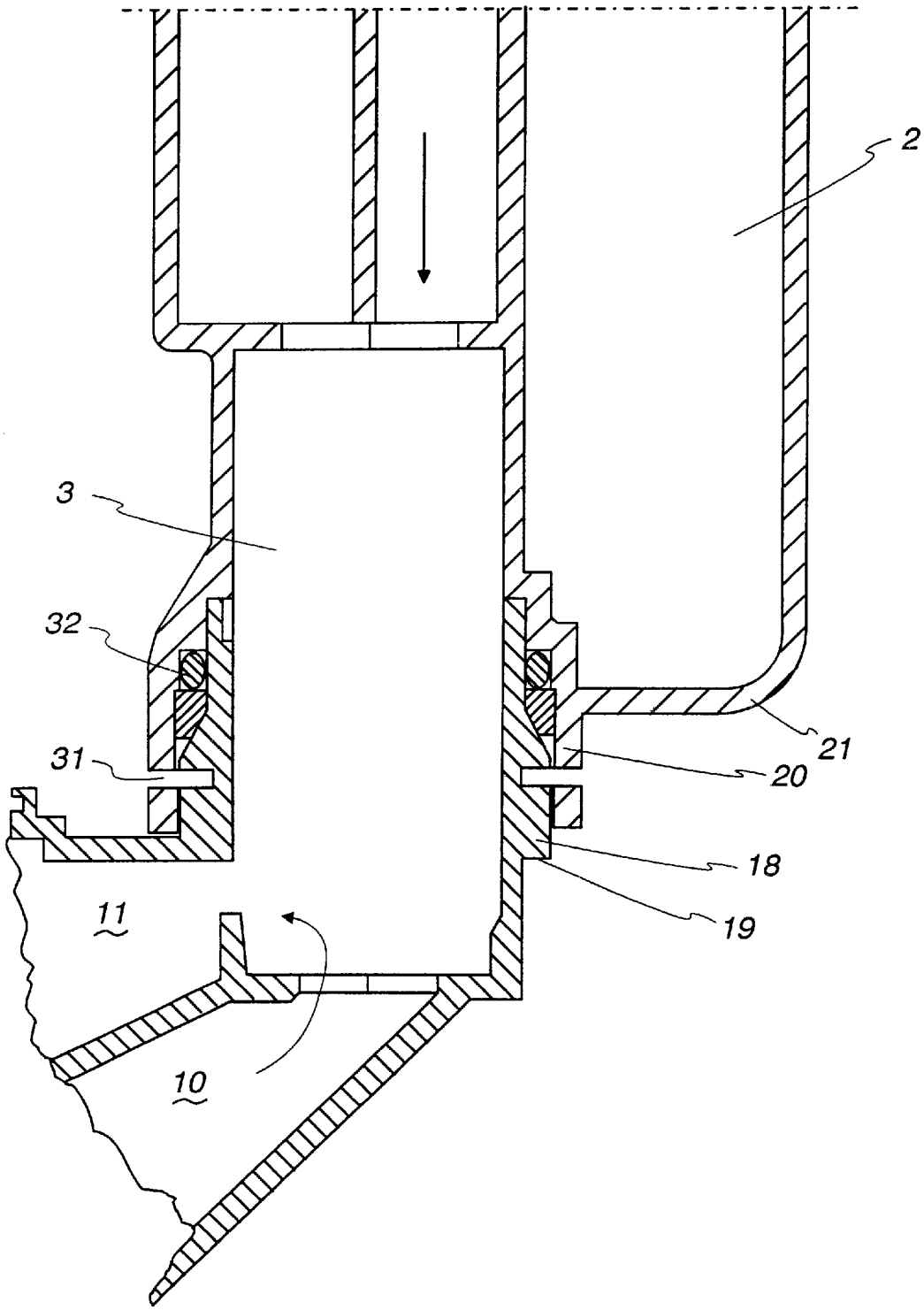
FIG. 6 shows mounting connectors forming a housing as a detail.

The flow channel (10) is also included in FIGS. 5 and 6, which show an equalization tank (2) with a schematized valve unit (3) situated in bottom (21). The valve unit (3) is found in an inserted housing (19), consisting of a lower (18) and an upper mounting connector (20). These connectors are preferably made of plastic. The lower mounting connector (18) forms a single component, together with the flow channel (10), which comes from the low-temperature region (14) and the flow channel (11), which leads from the mounting connector (18) to the flow connection of the heat exchanger (5). In the same manner, the return channel (28) from heat exchanger (5) with the return connection (29) of the equalization tank (2) and the return connector (30), which represents the connection for return to cooling water pump (8), forms a single plastic injection-molded part. The arrows included in FIG. 5 indicate flow through the equalization tank (2) and channels (10; 11; 28; 29). In the heating phase the part of the main coolant stream (12), shown with the upper horizontal arrow, enters the equalization tank (2). Part of it is branched off by means of valve unit (3) and fed to the transmission fluid cooler (5) via flow channel (11).

The water leaves the transmission fluid cooler (5) via return channel (28) and goes back to circulation. In the cooling phase, the cooling water comes from the low-temperature region (14) via flow channel (10) into flow channel (11), into transmission fluid cooler (5) and leaves it, as described. In the transitional region, the forward stream (1) is controlled by valve unit (3) so that part of the cooling water is fed to flow channel (11) via channel (10) from the low-temperature region (14) and another part from the equalization tank (2).

FIG. 6 shows the already described essential details of the housing (19), except for valve unit (3), in which the valve unit (3) itself is not shown for better clarity, but merely indicated by means of reference (3). The two parts of housing (19), the lower mounting connector (18) and the upper mounting connector (20), which is part of the equalization tank (2), are sealed outward by means of appropriate seals (32). Connection occurs by slits or a groove (31) on the wall side, in which a spring clamp is situated, which is not shown in the drawing. The arrows indicate flow of the water. The compact configuration that dispenses with separate lines is also apparent from this depiction, in which the lower mounting connection (18) and the flow channels (10 and 11) are designed as a single injection-molded part. Since the upper mounting connector (20), as already described, is molded directly into the bottom (21) of equalization tank (2), the number of individual parts is extremely low, which contributes to installation suitability.

Figure 7:
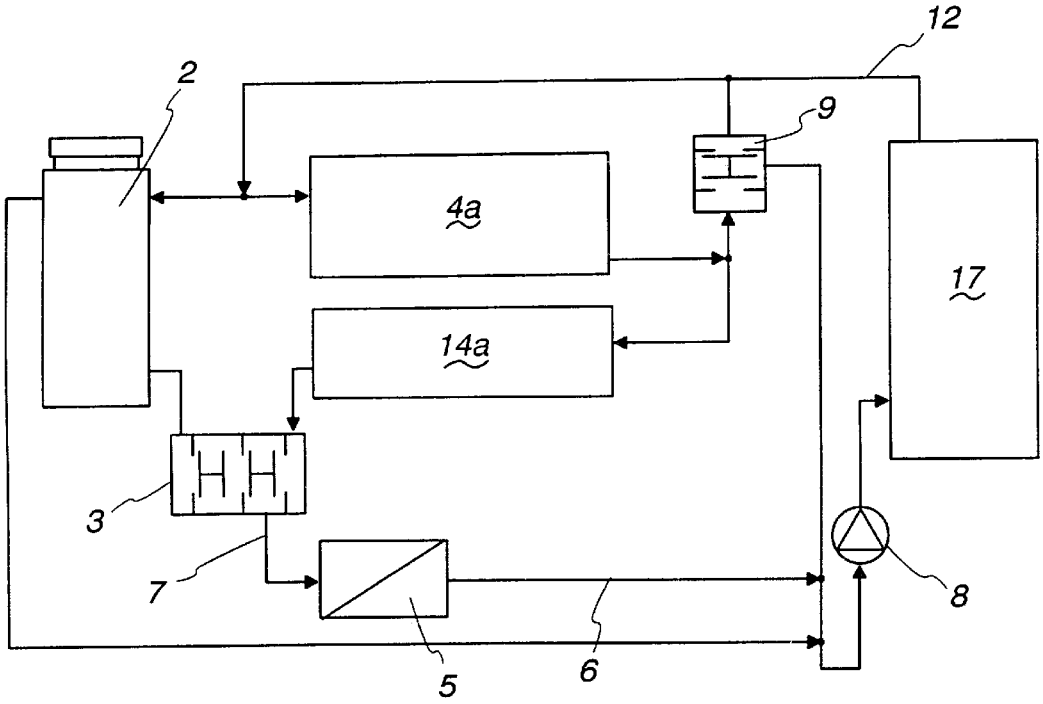
FIG. 7 shows a schematized circuit diagram with a separate low-temperature cooler.

The advantage that greater temperature differences for oil cooling can be achieved occurs in the variant according to FIG. 7, in which the low-temperature region (14) is omitted and was replaced by the separate low-temperature cooler (14*a*). This variant can also be advantageous if, for space reasons, the radiator (4) with low-temperature region (14) cannot be accommodated. For this purpose, a small radiator (4*a*) can be prescribed, in which arrangement of the separate low-temperature cooler (14*a*) can occur wherever the space conditions, for example, in a vehicle, permit. FIG. 7, as already explained in FIG. 1, represents the pure cooling phase, in which the main coolant stream (12) is passed through radiator (4*a*). The arrows drawn thicker show the flow path of the cooling water prevailing in this phase. The low-temperature cooler (14*a*) is connected after the radiator (4*a*) and is parallel to it. The water entering cooler (14*a*) reaches valve unit (3) and from there transmission fluid cooler (5), where efficient oil cooling is possible because of the large temperature difference.

What is claimed is:

1. A system for preheating or cooling a fluid with the coolant for an internal combustion engine comprising:

a cooling circuit including an internal combustion engine, a radiator and a first bypass for said radiator;

a heat exchanger having a coolant flow path and a fluid flow path for fluid to be preheated or cooled in heat exchange relation with said coolant flow path; and a first valve in said cooling circuit for controlling coolant flow from said radiator and said first bypass through said heat exchanger coolant flow path, said first valve having a) a first state causing coolant flow from only said first bypass through said heat exchanger coolant flow path to heat said fluid, b) a second state causing coolant to flow from both said radiator and said first bypass through said heat exchanger coolant flow path to cause said fluid to attain a desired temperature, and c) a third state causing coolant flow from only said radiator through said heat exchanger coolant flow path to cool said fluid.

2. The system according to claim 1, wherein the cooling circuit comprises a second bypass for said radiator; and a second valve in said cooling circuit for controlling coolant flow from said internal combustion engine through the radiator and the second bypass, said second valve having a) a first state causing coolant flow from said internal combustion engine through the second bypass and b) a second state causing coolant flow from said internal combustion engine through the radiator.

3. The system according to claim 2, wherein the second valve is in the first state when the first valve is in the first state.

4. The system according to claim 2, wherein the second valve is in the first state when the first valve is in the second state.

5. The system according to claim 2, wherein the second valve is in the second state when the first valve is in the third state.

6. The system according to claim 1, wherein the cooling circuit further comprises a valve housing in which the first valve is disposed, the valve housing having a one piece base with a first flow path connected to the radiator and a second flow path connected to the heat exchanger and a one piece cover with a third flow path connected to the first bypass.

7. The system according to claim 6, wherein the third flow path of the valve housing cover is attached to an equalization tank which is in the first bypass.

8. The system according to claim 7, wherein the cooling circuit further comprises a one piece connector with a fourth flow path connected to the equalization tank, a fifth flow path connected to the heat exchanger and a sixth flow path connected to the internal combustion engine such that coolant can pass through the equalization tank, the second, third, fifth and sixth flow paths with the valve in the first and second states and coolant can pass through the equalization tank and the fourth and sixth flow paths when the valve is in the third state.

9. The system according to claim 8, wherein the base and the cover have abuttable surfaces, one of the surfaces having a groove therein, and the valve housing comprises an O-ring disposed in the groove and compressed between the abuttable surfaces of the base and the cover with the surfaces abutting and the cover secured to the base.

10. A system for preheating or cooling a fluid with the coolant for an internal combustion engine comprising:

a cooling circuit including an internal combustion engine, a radiator and a first bypass for said radiator, a coolant flowing through the cooling circuit;

a heat exchanger having a coolant flow path for said coolant and a fluid flow path for another fluid to be preheated or cooled in heat exchange relation with said coolant in said coolant flow path; and a first thermostatic valve in said cooling circuit for directing said coolant from said at least one of said radiator and said bypass through said heat exchanger coolant flow path dependent upon an operating temperature of said coolant in the cooling circuit;

said cooling circuit comprising a second bypass for said radiator; and a second thermostatic valve in said cooling circuit for controlling coolant flow from said internal combustion engine through the radiator and the second bypass dependent upon an operating temperature of the cooling circuit;

said second thermostatic valve changing between a) a first state causing coolant flow from said internal combustion engine through the second bypass and b) a second state causing coolant flow from said internal combustion engine through the radiator at a first operating temperature of the coolant in the cooling circuit; and said first thermostatic valve changing between a) a first state causing coolant flow from only said first bypass through said heat exchanger coolant flow path to heat said fluid, and b) a second state causing coolant to flow from both said radiator and said first bypass through said heat exchanger coolant flow path to cause said fluid to attain a desired temperature at a second operating temperature of the coolant in the cooling circuit which is less than the first operating temperature.

11. A system for preheating or cooling a fluid with the coolant for an internal combustion engine comprising:

a cooling circuit including an internal combustion engine, a radiator and a first bypass for said radiator, the radiator having tubes with first and second ends, a first tank connected to the first ends of the tubes and having first and second ports and a baffle between the first and second ports to substantially limit the flow of coolant between the first and second ports except through the tubes, and a second tank connected to the second ends of the tubes and having a third port;

a heat exchanger having a coolant flow path and a fluid flow path for fluid to be preheated or cooled in heat exchange relation with said coolant flow path; and a first valve in said cooling circuit for controlling coolant flow from said the second port of said radiator and said first bypass through said heat exchanger coolant flow path.

12. The system according to claim 11, further comprising:

a second bypass for the radiator; and a second valve in said cooling circuit for controlling coolant flow from said the internal combustion engine through the third port of the radiator and the second bypass.

13. The system according to claim 12, wherein the second valve has a) a first state causing coolant flow from said internal combustion engine through the second bypass and b) a second state causing coolant flow from said internal combustion engine through the radiator from the first port to the third port of the radiator.

* * * * *